US011798330B2

(12) United States Patent
Shen

(10) Patent No.: US 11,798,330 B2
(45) Date of Patent: Oct. 24, 2023

(54) METHOD FOR OPERATING A LOCK DEVICE

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 165 days.

(21) Appl. No.: 17/583,319

(22) Filed: Jan. 25, 2022

(65) Prior Publication Data

US 2023/0196857 A1 Jun. 22, 2023

(30) Foreign Application Priority Data

Dec. 16, 2021 (TW) ..... 110147260

(51) Int. Cl.
*G07C 9/00* (2020.01)

(52) U.S. Cl.
CPC ..... *G07C 9/00309* (2013.01); *G07C 2009/00412* (2013.01); *G07C 2209/02* (2013.01)

(58) Field of Classification Search
None
See application file for complete search history.

(56) References Cited

U.S. PATENT DOCUMENTS

2003/0187805 A1* 10/2003 Shen ..... H04L 63/045 705/80
2016/0368455 A1* 12/2016 Kim ..... B60R 25/23

* cited by examiner

*Primary Examiner* — Carlos Garcia

(57) ABSTRACT

A method for operating a lock device includes installing a lock device application (lock APP) into a mobile device. A first identification information and a second identification information are inputted into the mobile device under guidance of the lock APP The lock APP can be connected with a lock device within a communication range of the mobile device. Then, a hardware serial number of the lock device is inputted into the mobile device to obtain the management authority of the lock device. A manager electronic key formed by the mobile device with the management authority of at least one lock device can grant the unlocking authority of a selected lock device to another user whose account name is provided to the manager electronic key. The unlocking procedure can be carried out based on one of a quick pass pattern, a single identification pattern, and a double identification pattern.

30 Claims, 3 Drawing Sheets

METHOD FOR OPERATING A LOCK DEVICE

BACKGROUND OF THE INVENTION

The present invention relates to a method fir operating a lock device and, more particularly, to a method for proceeding with management, unlocking operation, granting authority, or revoking authority of a lock device.

Locks are used in various situations to provide anti-theft functionality. For example, some known locks are used on doors, vehicles, cabinets, safes, etc. Conventional locks generally use a metal key for unlocking. Specifically, a lock can only be unlocked by inserting a proper key into a lock core of the lock. Thus, a user often has to carry plural keys and memorize every key and its associated lock, which is inconvenient to use. Furthermore, the mechanical structures of conventional locks have been analyzed and, thus, tend to be compromised. Thus, development of a lock management method using mobile phones as electronic keys is necessary.

BRIEF SUMMARY OF THE INVENTION

In a first aspect, the present invention provides a method for operating a lock device, comprising:

using a mobile device to register an account via a lock application (lock APP), wherein the account includes an account name and an account password which are set by a user using the mobile device;

creating a first identification information and a second identification information and storing the first and second identification informations in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

determining whether to change an identification pattern of an unlocking procedure, when the identification pattern is not changed, a preset identification pattern is selected from a quick pass pattern, a single identification pattern, and a double identification pattern and is used for the unlocking procedure, wherein when the identification pattern of the unlocking procedure is changed, another of the quick pass pattern, the single identification pattern, and the double identification pattern is selected as the preset identification pattern, wherein when the preset identification pattern is the quick pass pattern, the lock APP is operated to search for presence of a lock device within a communication range of the management electronic key, wherein when the manager electronic key is connected to a lock device present in the communication range, the manager electronic key sends an unlocking packet containing the manager digital key and an unlocking command to the lock device, wherein when the manager electronic key is not connected to any lock device, the manager electronic key does not send the unlocking packet, wherein when the preset identification pattern is the single identification pattern, the lock APP is operated to request input of a first real-time identification information, wherein when the first real-time identification information matches none of the first and second identification informations, searching for presence of a lock device within the communication range of the management digital key is not carried out, wherein when the first real-time identification information matches one of the first and second identification informations, searching for the presence of a lock device within the communication range of the management electronic key is carried out, wherein when the manager electronic key is connected to a lock device present in the communication range, the manager electronic key sends an unlocking packet containing the manager digital key and an unlocking command to the lock device, wherein when the manager electronic key is not connected to any lock device, the manager electronic key does not send the unlocking packet, wherein when the preset identification pattern is the double identification pattern, the lock APP is operated to request input of a first real-time identification information, wherein when the first real-time identification information matches none of the first and second identification informations, searching for the presence of a lock device within the communication range of the management digital key is not carried out, wherein when the first real-time identification information matches one of the first and second identification informations, searching for the presence of a lock device within the communication range of the management digital key is carried out, wherein the manager electronic key requests input of a second real-time identification information when the manager electronic key is connected to the lock device, wherein the manager electronic key does not request input of the second real-time identification information when the manager electronic key is incapable of connecting with the lock device, wherein when the second real-time identification information matches another of the first and second identification informations, the manager electronic key sends an unlocking packet to the lock device connected to the manager electronic key, wherein when the second real-time identification information does not match another of the first and second identification informations, the manager electronic key does not send the unlocking packet, wherein when the unlocking packet is determined by the lock device connected to the manager electronic key to be correct, the lock device connected to the manager electronic key is unlocked; and wherein when the unlocking packet is determined by the connected lock device to be incorrect, the lock device connected to the manager electronic key is not unlocked.

When executing the unlocking procedure based on the single identification pattern, the manager or the user is permitted to input the first real-time identification information corresponding to the first or second identification information by himself or herself, which provides convenient unlocking while protecting the privacy. Regarding the quick pass pattern, automatic unlocking can be carried out after connection with a lock device with an unlocking authority while the lock APP is running. Namely, the quick pass pattern does not need to carry out the unlocking procedure that requires input of the first real-time identification information or input of the first and second real-time identification informations, providing use convenience.

In an example, the lock APP obtains an unlocking information preset in the manager electronic key. The lock APP requests input of a real-time unlocking information before execution of the change of the identification pattern of the unlocking procedure. When the inputted real-time unlocking information matches the unlocking information preset in the manager electronic key, the change of the identification pattern of the unlocking procedure is carried out. When the inputted real-time unlocking information does not match the preset unlocking information of the manager electronic key, the change of the identification pattern of the unlocking procedure is not carried out.

In an example, determination of the unlocking packet by the lock device connected to the manager electronic key includes decrypting the unlocking packet to obtain the manager digital key and an unlocking command in the unlocking packet. The lock device connected to the manager electronic key executes the unlocking command to unlock the lock device connected to the manager electronic key when the management digital key is determined to be correct. When the management digital key is determined to be incorrect, the lock device connected to the manager electronic key does not execute the unlocking command and remains locked.

In an example, the lock APP obtains an unlocking information preset in the manager electronic key, wherein with the identification pattern being the single identification pattern:

when the first real-time identification information matches one of the first identification information, the second identification information, and the unlocking information preset in the manager electronic key, searching for the presence of a lock device within the communication range of the management electronic key is carried out, wherein when the first real-time identification information matches none of the first identification information, the second identification information, and the unlocking information preset in the manager electronic key, searching for the presence of a lock device within the communication range of the management electronic key is not carried out.

In an example, the lock APP obtains an unlocking information preset in the manager electronic key, wherein with the identification pattern being the double identification pattern:

when the first real-time identification information matches one of the first identification information, the second identification information, and the unlocking information preset in the manager electronic key, searching for the presence of a lock device within the communication range of the management digital key is carried out, wherein the lock APP requests input of a second real-time identification information when the manager electronic key is connected to a lock device present within the communication range of the management electronic key, wherein when the second real-time matches one of remaining two of the first identification information, the second identification information, and the unlocking information preset in the manager electronic key, the manager electronic key sends the unlocking packet to the lock device connected to the manager electronic key, wherein when the second real-time matches none of the remaining two of the first identification information, the second identification information, and the unlocking information preset in the manager electronic key, the manager electronic key does not send the unlocking packet to the lock device connected to the manager electronic key, when the first real-time identification information matches none of the first identification information, the second identification information, and the unlocking information preset in the manager electronic key, searching for the presence of a lock device within the communication range of the management digital key is not carried out.

In an example, the method further comprises:

using the manager electronic key to connect with a plurality of another lock devices to thereby create a plurality of another management digital keys respectively associated with the plurality of another lock devices by respectively inputting a plurality of another hardware serial numbers respectively associated with the plurality of another lock devices, wherein the management digital key and the plurality of another management digital keys are stored in the manager electronic key;

using another mobile device to register another account via the lock APP, wherein the another account includes another account name and another account password which are set by another user using the another mobile device;

creating a third identification information and a fourth identification information and storing the third and fourth identification informations in the another mobile device;

providing the registered another account of the another mobile device to the manager electronic key;

using the manager electronic key to select one of the management digital key and the plurality of another management digital keys according to the another account name of the registered another account, wherein the unlocking authority of the selected one of the management digital key and the plurality of another management digital keys is to be granted to the another mobile device and is used to create an unlocking digital key containing the hardware serial number of an associated lock device whose unlocking authority is to be granted;

sending an authorization packet containing the unlocking digital key to the another mobile device, wherein when decryption of the received authorization packet fails, the another mobile device is incapable of obtaining the unlocking digital key, wherein when decryption of the received authorization packet is successful, the another mobile device obtains the unlocking digital key and becomes a user electronic key;

wherein when the quick pass pattern is set as an identification pattern of an unlocking procedure of the unlocking digital key of the user electronic key, the lock APP is executed to search for the presence of a lock device within a communication range of the user electronic key, wherein when the user electronic key is connected to a lock device within the communication range of the user electronic key, the user electronic key sends another unlocking packet containing the unlocking digital key and an unlocking command to the lock device connected to the user electronic key, and wherein when the user electronic key is not connected to any lock device, the user electronic key does not send the another unlocking packet.

In an example, determination of the another unlocking packet by the lock device connected to the user electronic key includes decrypting the another unlocking packet to obtain the unlocking digital key and the unlocking command in the another unlocking packet sent by the user electronic key, wherein the lock device connected to the user electronic key executes the unlocking command to unlock the lock device connected to the user electronic key when the unlocking digital key is determined to be correct, and wherein when the unlocking digital key is determined to be incorrect, the lock device connected to the user electronic key does not execute the unlocking command and remains locked.

In an example, with the single identification pattern set as the identification pattern of the unlocking procedure for the user electronic key:

the user electronic key executes the lock APP to request input of a third real-time identification information, wherein when the third real-time inputted into the user electronic key matches one of the third identification information, the fourth identification information, and an unlocking information of the user electronic key, searching for the presence of a lock device within the communication range of the user electronic key is carried out, wherein when the third real-time inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key, the user electronic key sends another unlocking packet to the lock device connected to the user electronic key, wherein when the user electronic key is not connected to any key, the user electronic lock device does not send the another unlocking packet.

In an example, with the double identification pattern set as the identification pattern of the unlocking procedure of the user electronic key:

wherein when a third real-time identification information inputted into the user electronic key matches one of the third identification information, the fourth identification information, and the unlocking information of the user electronic key, searching for the presence of a lock device within the communication range of the user electronic key is carded out, wherein when the third real-time identification information inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key, the user electronic key requests input of a fourth real-time identification information, wherein when the user electronic key is not connected to any lock device, the user electronic key does not request input of the fourth real-time identification information.

wherein when the inputted fourth real-time identification information matches one of remaining two of the third identification information, the fourth identification information, and the unlocking information of the user electronic key, the user electronic key sends another unlocking packet to the lock device connected to the user electronic key, wherein when the inputted second real-time identification information matches none of the remaining two of the third identification information, the fourth identification information, and the unlocking information of the user electronic key, the user electronic key does not send the another unlocking packet to the lock device connected to the user electronic key.

While granting the unlocking authority, the identification pattern for the unlocking procedure can be selected from one of the quick pass pattern, the single identification pattern, and the double identification pattern. Thus, the holder of the manager electronic key can select a proper identification pattern based on the identify of the person seeking unlocking authority, the relationship between the person and the holder, the situation of granting unlocking authority, etc.

In an example, the method further comprises:

binding the account name, the account password, and the management digital key together as a first packet and sending the first packet to a server;

binding the another account name, the another account password, and the unlocking digital key together as a second packet and sending the second packet to the server;

wherein when the manager digital key and the user electronic key execute the lock APP, the lock APP is connected to the server to verify presence of valid authority of the management digital key of the manager electronic key and presence of valid authority of the unlocking digital key of the user electronic key, wherein when the valid authority of the management digital key of the manager electronic key is not present, the management digital key of the manager electronic key without valid authority is deleted, wherein when the valid authority of the management digital key of the manager electronic key is present, the management digital key of the manager electronic key is kept, wherein when the valid authority of the unlocking digital key of the user electronic key is not present, the unlocking digital key of the user electronic key without valid authority is deleted, wherein when the valid authority of the unlocking digital key of the user electronic key is present, the user digital key of the user electronic key is kept.

The authorization information ca be transmitted back to the server. The holder of the manager electronic key can remotely connect the manager electronic key with the server at any time to delete the unlocking authority of the unlocking digital key. When the user electronic key executing the lock APP and connected to the server verifies that there is no presence of valid authority of the unlocking digital key, the lock APP can automatically delete the unlocking digital key from the user electronic key. Thus, the user electronic key automatically loses the unlocking authority of the lock device associated with the unlocking digital key that has been deleted, providing excellent convenience and safety in operation of unlocking authority.

In an example, an authorization period is simultaneously set while creating the unlocking digital key, and wherein the unlocking digital key with an expired authorization period is deleted while executing the lock APP.

In a second aspect, the present invention provides a method for operating a lock device, comprising:

using a mobile device to register an account via a lock application (lock APP), wherein the account includes an account name and an account password which are set by a user using the mobile device;

creating a first identification information and a second identification information and storing the first and second identification informations in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

operating the lock APP to selectively execute a single identification pattern, requesting input of a first real-time identification information, wherein when the first real-time identification information matches none of the first and second identification informations, searching for the presence of a lock within a communication range of the manager electronic key is not carried out, wherein when the first real-time identification information matches one of the first and second identification informations, searching for the presence of a lock within the communication range of the manager electronic key is carried out, wherein when the manager electronic key is connected to a lock device within communication range of the manager electronic key, the manager electronic key sends an unlocking packet to the lock device connected to the manager electronic key, wherein when the manager electronic key is not connected to any lock device, the manager electronic key does not send the unlocking packet, wherein when the unlocking packet is determined to be correct, the lock device connected to the manager electronic key is unlocked, wherein when the unlocking packet is determined to be incorrect, the lock device connected to the manager electronic key is not unlocked.

Regarding the quick pass pattern, automatic unlocking can be carried out after connection with a lock device with an unlocking authority while the lock APP is running. Namely, the quick pass pattern does not need to carry out the unlocking procedure that requires input of the first real-time identification information or input of the first and second real-time identification informations, providing use convenience.

In a third aspect, the present invention provides a method for operating a lock device, comprising:

using a mobile device to register an account via a lock application (lock APP), wherein the account includes an account name and an account password which are set by a user using the mobile device;

creating a first identification information and a second identification information and storing the first and second identification informations in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

operating the lock APP to selectively execute a sdouble identification pattern, thereby requesting input of a first real-time identification information, wherein when the first real-time identification information matches none of the first and second identification informations, searching for the presence of a lock device within the communication range of the management digital key is not carried out, wherein when the first real-time identification information matches one of the first and second identification informations, searching for the presence of a lock device within the communication range of the management digital key is carried out, wherein the manager electronic key requests input of a second real-time identification information when the manager electronic key is connected to the lock device, wherein the manager electronic key does not request input of the second real-time identification information when the manager electronic key is incapable of connecting with the lock device, wherein when the second real-time identification information matches another of the first and second identification informations, the manager electronic key sends an unlocking packet to the lock device connected to the manager electronic key, wherein when the second real-time identification information does not match another of the first and second identification informations, the manager electronic key does not send the unlocking packet;

wherein when the unlocking packet is determined to be correct, the lock device connected to the manager electronic key is unlocked, wherein when the unlocking packet is determined to be incorrect, the lock device connected to the manager electronic key is not unlocked.

The present invention will become clearer in light of the following detailed description of illustrative embodiments of this invention described in connection with the drawings.

DETAILED DESCRIPTION OF THE INVENTION

Figure 1:
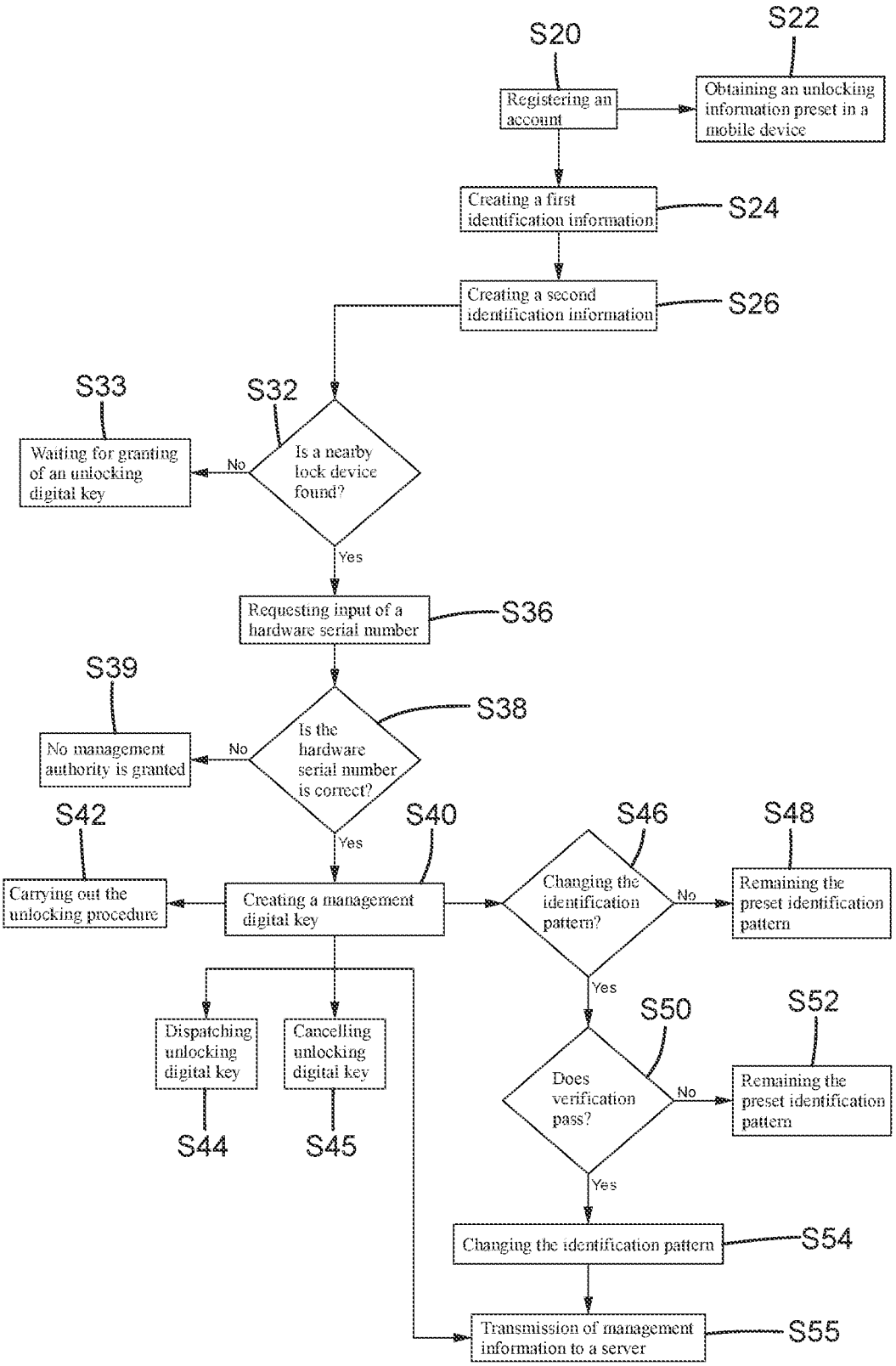
FIG. 1 is a flowchart illustrating setting a mobile device as a manager electronic key of a lock device.

The present invention relates to a method for operating a lock device and, more particularly, to a method for obtaining management authority and revoking authority of at least one lock device. The method includes at least one mobile device and at least one lock device. With reference to FIG. 1, a lock device application (hereinafter referred to as "lock APP") is downloaded and installed into a mobile device, and an account must be registered according to the instructions of the lock APP. The account may include an account name and an account password (step S20, registering an account). Hereinafter, the mobile device of a manager is referred to as "the manager mobile device," and the mobile device of a user is referred to as "the user mobile device." Furthermore, the account name can be, but not limited to, an email account of the holder (the manager or the user) of the mobile device. The account password can be comprised of, but not limited to, numbers or alphabets or combinations thereof. The mobile device can be, but not limited to, a device currently available on the market, such as a smart phone, a tablet computer, a smart watch, and/or notebook computer. Furthermore, the mobile device can be a device particularly manufactured to match the lock device, such as a mobile device with Bluetooth, radio frequency identification (RBI)), and/or nearfield communication (NFC). A non-restrictive example of the mobile device is an electronic key with a touch screen.

The lock can be, but not limited to, a door lock installed on a door, an anti-theft lock installed on a vehicle, equipment installed on a door and operable to push open the door upon reception of a command, a lock installed on a safe, a lock installed on a cabinet, or any other lock.

Furthermore, it is noted that when the lock APP is installed or the lock APP operates for the first time, a request for authority of an unlocking information preset in the mobile device will be demanded (step S22: requesting preset unlocking information of the mobile device). For example, in a case that a smart phone available on the market is used, a fingerprint is preset as the unlocking information of the smart phone. Namely, when a correct fingerprint is inputted into the smart phone, a touch screen of the smart phone will be unlocked to permit operation of the smart phone. Thus, when the lock APP is installed or the lock APP is operated for the first time, a holder of the smart phone will be requested to operate the smart phone to thereby permit the lock APP to pick up the fingerprint information of the smart phone. Furthermore, in a case that the smart phone is an iPhone of Apple Incorporation, the unlocking information can be a Face ID.

After the account name and the account password are inputted, the lock APP further requests the user to create a first identification information (step S24: creating a first identification information). The first identification information can be a password. For example, the first identification information may be numbers or alphabets or combinations thereof. Alternatively the first identification information may be a figure, a pattern, etc. In the case of a mobile device, the first identification information can be inputted via the touch screen of the mobile device.

After the first identification information is created, the lock APP further requests the user to set a second identification information (step S26: creating a second identification information). The second identification information can be a face information of the user. For example, a front camera lens of the smart phone can be used to pick up the face image of the user upon request of the lock APP, and the picked-up face image is set as the second identification information and is stored in a storage unit of the smart phone.

When the mobile device sets the account number and the first and second identification informations, the mobile device will automatically search whether any lock device is present in a wireless communication range of the mobile device (step S32: whether a lock device near the mobile device is found). When the mobile device is not connected to any new lock device, a management digital key corresponding to any lock device cannot be created. The mobile device becomes a user mobile device. In this case, the mobile device (the user mobile device) can obtain the unlocking authority of at least one lock device only after granting by a manager mobile device with the management authority of the at least one lock.

For example, the lock APP uses a Bluetooth device of the smart phone to search whether any connectable lock device is present in the communication range of the Bluetooth device using Bluetooth technology. When no lock device is present in the wireless communication range of the smart phone, the smart phone cannot be connected to any lock device. In this state, the smart phone cannot create a management digital key corresponding to a lock device. Namely, even if the smart phone has completed registration of an account and has created the first and second identification informations, the smart phone still has no management authority for any lock device and, thus, cannot unlock any lock device via the lock APP (step S39: no management authority). In this state, the smart phone can only be granted with the unlocking authority after authorization by the manager with the management authority (step S33: waiting for granting of an unlocking digital key). The smart phone granted with the unlocking authority will be referred to as "the user mobile device" hereinafter.

On the other hand, when a lock device is present in the wireless communication range of the smart phone, the smart phone can be connected to the found lock device via wireless connection. After connection between the smart phone and the lock device, the lock APP requests a user to input a hardware serial number corresponding to the connected lock device (step S36: requesting input of a hardware serial number). For example, after the smart phone is connected to the lock device via the Bluetooth communication function, the lock APP installed in the smart phone requests the holder of the smart phone to input a hardware serial number. For example, the hardware serial number is carried on a card which is given to a consumer purchasing the hardware of the lock device.

After a hardware serial number is entered upon request by the lock APP, since the mobile device is in connection with the lock device, it can be determined that whether the hardware serial number inputted via the mobile device is the same as the hardware serial number of the lock device connected to the mobile device (step S38: determining whether the hardware serial number is correct). For example, the inputted hardware serial number is sent to the lock device and is compared with the hardware serial number of the lock device, and the comparison result is sent back to the mobile device. Alternatively, after the mobile device is connected to the lock device, the hardware serial number of the lock device obtained via the lock APP is compared with the inputted hardware serial number to determine whether or not they match each other.

When the inputted hardware serial number is incorrect, the smart phone cannot create a management digital key corresponding to the lock device. In this case, the mobile device can obtain the unlocking authority of the lock device only after granting by a manager mobile device with the management authority of the lock device (step S33: waiting for granting of an unlocking digital key). The smart phone granted with the unlocking authority will be referred to as "the user mobile device" hereinafter.

On the other hand, when the inputted hardware serial number is correct, a management digital key for the connected lock device is created in the mobile device (manager mobile device) (step S40: creating a management digital key). The management digital key includes a hardware serial number corresponding to the associated lock device. The above procedure can be repeated until the mobile device stores a plurality of management digital keys associated with a plurality of lock devices. The mobile device storing at least one management digital key will be referred to as "the manager electronic key" hereinafter.

It is noted that the management authority of the manager electronic key includes, but not limited to, management of the unlocking authorities of the lock devices, granting the unlocking authorities of the lock devices to another device, or cancelling the unlocking authority of the lock devices from another device. Namely, the manager electronic key can be used to lock or unlock a lock device whose unlocking authority is owned by the manager electronic key (step S42: unlocking). Furthermore, the manager electronic key can be used to grant the unlocking authority of a lock device (whose unlocking authority is owned by the manager electronic key) to a registered user (step S44: dispatching unlocking digital key) or cancelling the unlocking authority of a registered user (step S45: cancelling unlocking digital key).

Furthermore, when the identification of the hardware serial number inputted via the smart phone fails, the smart phone cannot suggest creation of a management digital key corresponding to the connected lock device, and the smart phone cannot obtain the management authority of the connected lock device (step S39: no management authority is granted).

When the manager electronic key does not change an identification pattern of an unlocking procedure during unlocking, using a preset identification pattern to request unlocking is used while carrying out the unlocking procedure (step S46: determining whether to change the identification pattern; step S48: remaining the preset identification pattern). When it is desired to change the identification pattern of the unlocking procedure, one of a quick pass pattern, a single identification pattern, and a double identification pattern is selected as the preset identification pattern for the unlocking procedure. For example, in a case that the single identification pattern is preset by the lock APP as the identification pattern, when the manager electronic key is used to unlock a lock device whose management digital key has been created while the identification pattern is not changed, the lock APP directly executes the single identification pattern to request the manager to use the manager electronic key for executing the unlocking procedure.

It is noted that before the operation for changing the identification pattern of the unlocking procedure, the lock APP will request the user to input of a real-time unlocking information (step S50: whether verification passes). When the real-time unlocking information is identical to the unlocking information of the manager electronic key (the manager mobile device), the operation of changing the identification pattern of the unlocking procedure is carried out (step S54: change the preset identification pattern to the selected identification pattern). When the real-time unlocking information does not match the unlocking information of the manager electronic key, the operation of changing the identification pattern of the unlocking procedure cannot be carried out (step S52: remaining the preset identification pattern).

For example, in a case that the preset unlocking information for unlocking a touch screen of the manager electronic key is a fingerprint, before the operation of changing the identification pattern, the lock APP guides the manager to input a fingerprint as the real-time unlocking information. Then, the manager electronic key determines whether the inputted fingerprint matches another fingerprint stored in the manager electronic key. When they match, the lock APP permits operation of the change of the identification pattern. When they do not match, the lock APP does not permit operation of the change of the identification pattern.

After binding, the account number, the account password, and the management digital key are transmitted back to a server (step S55: transmission of management information). Specifically, after creating the management digital key, the lock APP binds the account number, the account password, and the management digital key together (such as forming a packet after encryption) and sends them to the server for storage. In a case that the identification pattern is changed by the management digital key, the account number, the account password, and the management digital key are also hound together and then sent to the server for storage.

In an example, one of a plurality of mobile devices is used as the manager electronic key storing a plurality of manage digital keys corresponding to a plurality of lock devices, and the remaining mobile devices can be turned into user electronic keys each containing or not containing a user digital key for an associated lock device. In another example, one of a plurality of mobile devices can be used as the manager electronic key for a lock device and can be used as a user electronic key for another lock device.

In the case of registering a mobile device as a user electronic key, another account (including another account name and another account password) is used, and third and fourth identification informations are created in this mobile device. The third identification information may be identical or not identical to the first identification information, and the fourth identification information may be identical or not identical to the second identification information. Furthermore, input of a first real-time identification information and/or a second real-time identification information through the manager electronic key during operation for comparison with the first identification information, the second identification information, and an unlocking information of the manager electronic key may be required. Likewise, input of a third real-time identification information and/or a fourth real-time identification information through the user electronic key for comparison with the third identification information, the fourth identification information, and an unlocking information of the user electronic key during operation may be required. The third real-time identification information may be identical or not identical to the first real-time identification information, and the fourth real-time identification information may be identical or not identical to the second real-time identification information. For ease of explanation, it is assumed that the third identification information is identical to the first identification information, the fourth identification information is identical to the second identification information, the third real-time identification information is identical to the first real-time identification information, the fourth real-time identification information is identical to the second real-time identification information. Nevertheless, it is noted that the two identification informations and the two real-time identification informations of the user electronic key may be different from those of the manager electronic key.

Figure 2:
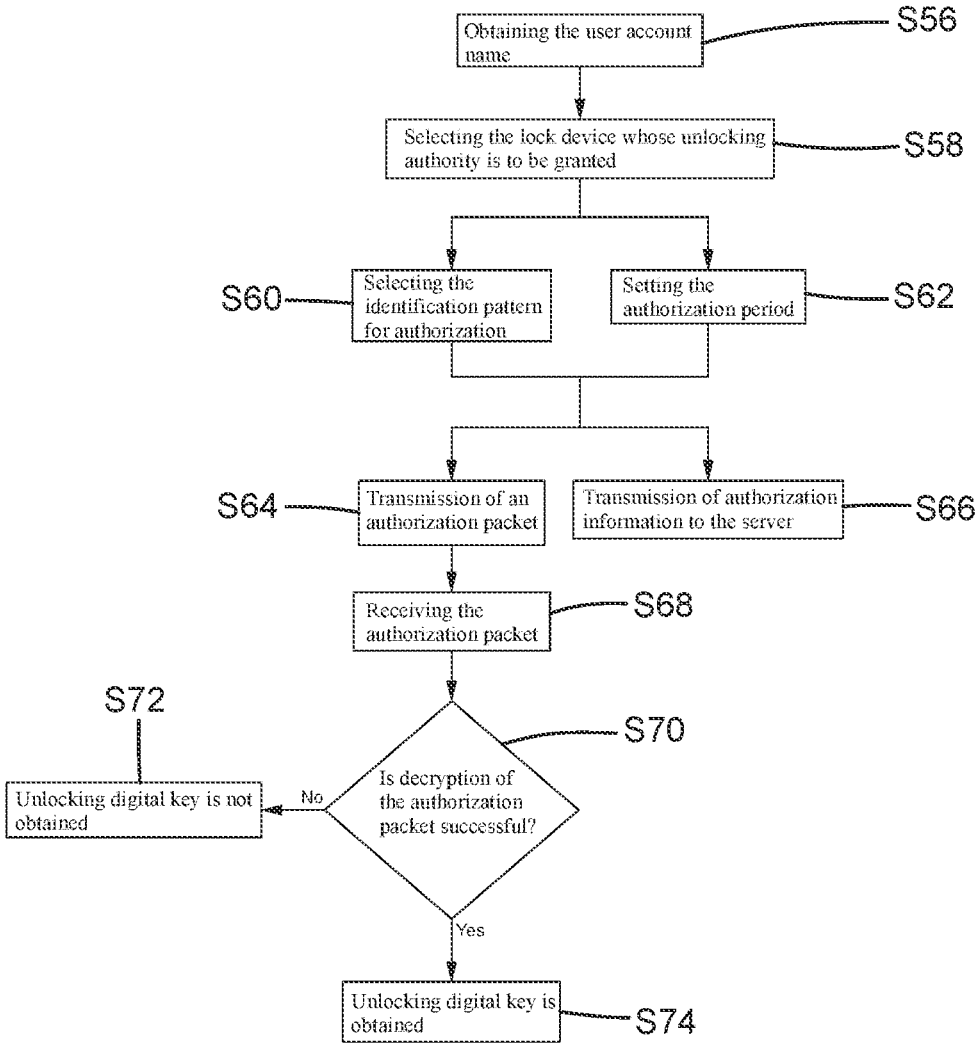
FIG. 2 is a flowchart illustrating sending unlocking authority from the manager electronic key to another user's mobile device to set the another user's mobile device as a user electronic key.

With reference to FIG. 2, a user mobile device has no unlocking authority of any lock device before authorization via the manager electronic key. When it is intended to grant the unlocking authority of at least one lock device to the user mobile device, a holder of the user mobile device is required to provide his or her registered account to the holder of the manager electronic key (step S56: obtaining the user account name). For example, in a case that the user mobile device uses an email account as a user name account of the lock APP, the holder of the user mobile device has to provide the email account number to the holder of the management mobile device. The management mobile device can use the account name as the object for authorization.

After an account name of a user is inputted into the manager electronic key, a to-be-granted unlocking authority is selected from the management digital key owned by the manager electronic key to create an unlocking digital key with the hardware serial number associated with the lock device whose unlocking authority is to be granted (step S58: selecting the lock device whose unlocking authority is to be granted). Specifically, the manager electronic key may have a plurality of management digital keys respectively for a plurality of lock devices. When the manager electronic key proceeds with granting of the unlocking authority, selection of a lock device (whose unlocking authority is to be granted) can be achieved by selecting an associated management digital key.

After the lock device (whose unlocking authority is to be granted) is selected, the identification pattern of the unlocking procedure for the unlocking digital key is selected from the quick pass pattern, the single identification pattern, and the double identification pattern (step S60). Specifically, the holder of the manager electronic key can select the desired identification pattern according to the identity of the user to be authorized, or the unlocking level of the lock device (whose unlocking authority is to be granted), and/or other factors.

Furthermore, after selection of the lock device whose unlocking authority is to be granted, an effective period of time may be set for the unlocking digital key created (step S62: setting the authorization period). Alternatively, the effective period of time may not be set, such that the effective period of time of the unlocking digital key is not restricted.

After determining the identification pattern of the unlocking digital key and the optional authorization period, an authorization packet (containing the unlocking digital key, the selected identification pattern of the unlocking procedure, and the optional authorization period) is transmitted to a user mobile device corresponding to the user's registered account (step S64: transmission of an authorization packet). Furthermore, the manager electronic key sends the user's account name and the unlocking digital key (bound with the user's account name) back to the server (step S66: transmission of authorization information to the server). It is worth noting that the authorization packet may be encrypted, and the unlocking digital key bound with the user's account name transmitted back to the server may be encrypted, such that the transmission and reception will be safer.

After the authorization packet is sent out from the manager electronic key, the associated user mobile device can receive the authorization packet via the lock APP (step S68: receiving the authorization packet).

After the user mobile device receives the authorization packet, the lock APP decrypts the encrypted authorization packet (step S70: whether decryption of the authorization packet is successful). In a case that the decryption is unsuccessful, the user mobile device cannot obtain the unlocking digital key (step S72). In another case that the decryption is successful, the user mobile device obtains the unlocking digital key (step S74). The user mobile device owning the unlocking authority of at least one lock device will be referred to as "the user electronic key" hereinafter.

Figure 3:
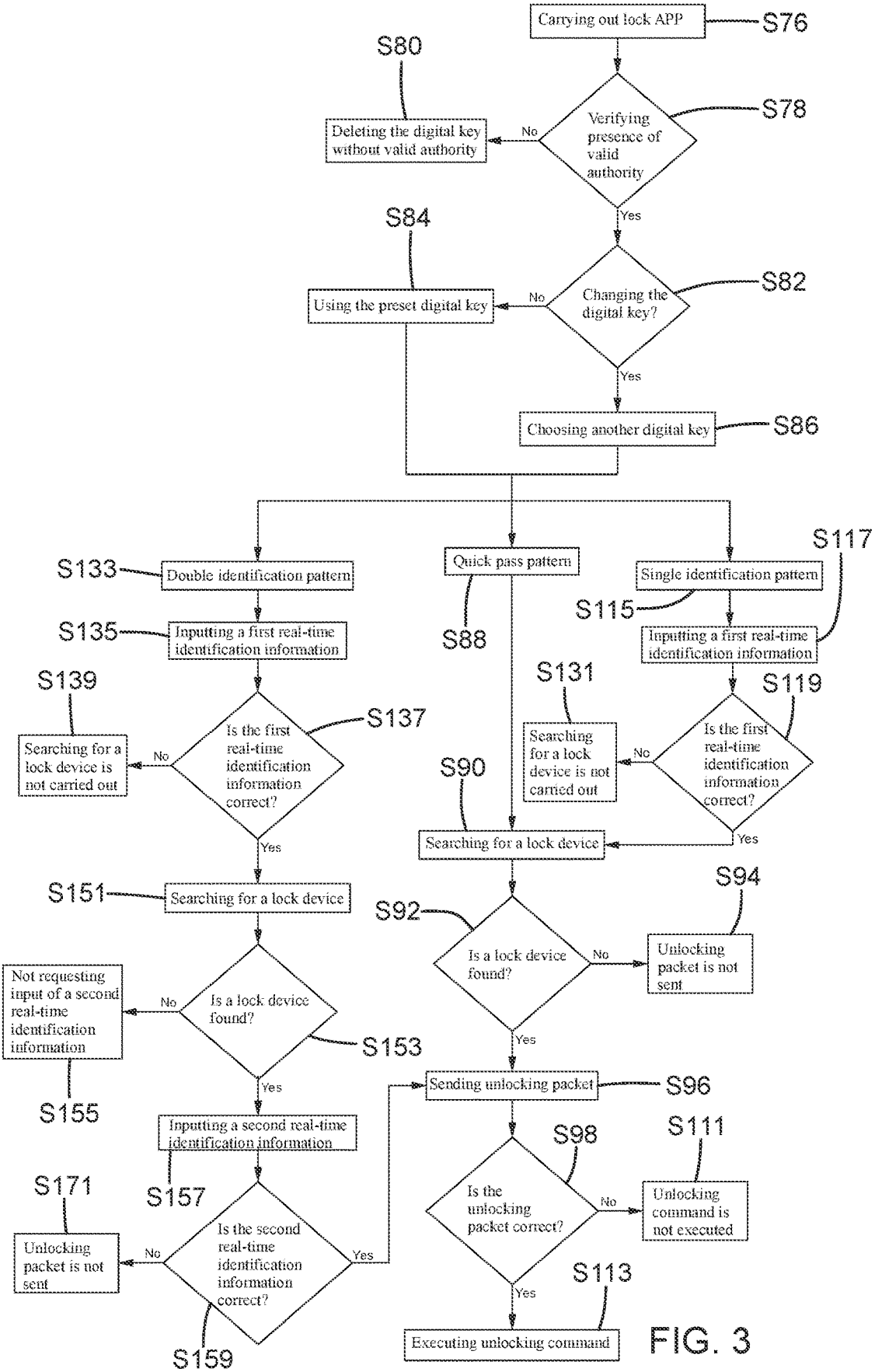
FIG. 3 is a flowchart illustrating execution of an unlocking procedure by the manager electronic key and the user electronic key.

With reference to FIG. 3, the manager electronic key permits operation of the unlocking procedure of at least one lock device whose management authority is owned by the manager electronic key. The user electronic key permits operation of the unlocking procedure of at least one lock device whose management authority is owned by the user electronic key. The lock APP is required for carrying out the unlocking procedure for both the manager electronic key and the user electronic key (step S76: carrying out lock APP).

Taking the unlocking procedure executed by the manager electronic key with the management authority of a plurality of lock devices as an example, when the lock APP is carried out by the manager electronic key, the lock APP is connected to the server to verify presence of valid authority of the management digital key of the manager electronic key (step S78: verifying presence of valid authority). In a case that there is no valid authority of the management digital key of the manager electronic key, the management digital key of the manager electronic key without valid authority is deleted (step S80: deleting the management digital key without valid authority). In another case that valid authority of the management digital key of the manager electronic key is present, the management digital key of the manager electronic key is kept.

Namely, in the case that the management digital key is permitted to be deleted, the management authority of the lock device can be transferred. For example, when an original manager intends to transfer the management authority of the lock device to another person, the management digital key held by him or herself can be used to execute the lock APP to thereby delete the management digital key associated with the lock device whose management authority is to be transferred. Thus, the lock APP sends the to-be-deleted management digital key to the server, such that the manager electronic key loses the management authority and the unlocking authority of the lock device. As a result, the manager electronic key without the management digital key cannot carry out operations of granting authority, cancelling authority, and unlocking of the lock device with the management digital key. A new manager can obtain the management authority of the lock device by executing the lock APP to create a connection with the lock device followed by inputting the correct hardware serial number.

In a case that the manager electronic key owns a plurality of management digital keys respectively of a plurality of lock devices, when it is desired to operate the unlocking procedure by the manager electronic key through execution of the lock APP, either the management digital key preset by the system or one of the plurality of the management digital keys can be selected to carry out an unlocking procedure of an associated lock device (step S82: whether to change the management digital key). When it is determined not to change the management digital key for the unlocking procedure, the lock APP automatically choses the preset management digital key (step S84: using the preset management digital key). On the other hand, when it is determined to change the management digital key for the unlocking procedure, and one of the plurality of the management digital keys can be selected as the management digital key for the unlocking procedure (step S86: choosing another management digital key).

After determination of the management digital key for the unlocking procedure, the lock APP executes the quick pass pattern, the single identification pattern, or the double identification pattern based on the set identification pattern for the selected unlocking authority. When the quick pass pattern is selected for the management digital key (step S88), operation of the lock APP will directly search whether any lock device is present in the communication range of the manager electronic key (step S90: searching lock device). In step S92, it is determined whether a lock device is found. When the manager electronic key is in connection with a lock device, the manager electronic key sends an unlocking packet (containing the management digital key and an unlocking command) to the lock device (step S96). When no lock device is connected to the manager electronic key, the lock APP does not send the unlocking packet (step S94). It is worth noting that the unlocking packet can be encrypted before sending, such that the information contained in the unlocking packet cannot be easily cracked even if the unlocking packet is intercepted during transmission.

In step S98, it is determined whether the unlocking packet is correct. When the unlocking packet is determined to be correct, the unlocking command is conducted (step S113). On the other hand, when the unlocking packet is determined to be incorrect, the unlocking command is not conducted (step S111). Specifically, after the manager electronic key sends the unlocking packet to the lock device connected thereto, the lock device decrypts the unlocking packet to obtain the management digital key and the unlocking command. Then, the hardware serial number contained the management digital key is compared with the hardware serial number of the lock device itself. The unlocking command is conducted when they match, and the unlocking command is not conducted when they don't. On the other hand, the management digital key and the unlocking command cannot be obtained when the lock device cannot decrypt the unlocking packet, such that the lock device cannot execute the unlocking command and, thus, remains in a forbidden state (such as unlocked).

When the lock device does not execute the unlocking command, the lock device remains in the forbidden state. In a case that the lock device is a door lock, the door lock remains locked, and a door to which the door lock is mounted cannot be opened. On the other hand, when the lock device executes the unlocking command, the forbidden state of the lock device is lifted. In a case that the lock device is a door lock, the door lock is unlocked, and a door to which the door lock is mounted can be opened.

In a case that the identification pattern preset by the manager electronic key is the single identification pattern (step S115), the lock APP, when executed, requests input of a first real-time identification information (step S117: inputting a first real-time identification information). In step S119, it is determined whether the first real-time identification information is correct by comparing it with the unlocking information, the first identification information, and second identification information of the manager electronic key (the manager mobile device, see step 119). When the first real-time identification information matches none of the unlocking information of the manager electronic key, the first identification information, and second identification information, searching for the presence of a lock device within the communication range is not carried out (step S131). On the other hand, when the first real-time identification information matches one of the unlocking information, the first identification information, and the second identification information of the manager electronic key, searching for the presence of a lock device within the communication range is carried out (step S90). In step S92, it is determined whether a lock device is found. When the manager electronic key is connected to a lock device, the manager electronic key sends an unlocking packet (containing the management digital key and an unlocking command) to the lock device (step S96). When no lock device is connected to the manager electronic key, the lock APP does not send the unlocking packet (step S94).

Specifically, the first real-time identification information will be determined as correct when the first real-time identification information matches one of the unlocking information, the first identification information, and the second identification information of the manager electronic key (the manager mobile device). For example, the unlocking information of the manager electronic key is facial data of a person, the first identification is a password, and the second identification is a fingerprint of the manager. When the single identification pattern operates, an interface of the lock APP requests input of facial data, a password, or a fingerprint (which can be chosen by the manager). In a case that the manager choses to input facial data as the first real-time identification information, the lock APP compares the first real-time identification information with the unlocking information. In another case that the manager choses to input a password as the first real-time identification information, the lock APP compares the first real-time identification ninformation with the first identification information. In a further case that the manager choses to input a fingerprint as the first real-time identification information, the lock APP compares the first real-time identification information with the second identification information. Namely, the inputted the first real-time identification information only has to match one of the first and second identification informations and the unlocking informant of the manager electronic key.

When the unlocking packet is determined by the lock device as correct, the lock device is unlocked (step S113: executing the unlocking command). On the other hand, when the unlocking packet is determined by the lock device as incorrect, the lock device is not unlocked (step S111: not executing the unlocking command). The processes for identifying the unlocking packet and execution of the unlocking command are the same as those of the quick pass pattern and, thus, will not be described to avoid redundancy.

In a case that the selected management digital key is set to the double identification pattern, the lock APP, when executed, requests input of a first real-time identification information (step S135). In step S137, it is determined whether the first real-time identification information is correct. When the first real-time identification information matches none of the unlocking information, the first identification information, and the second identification information of the manager electronic key (the manager mobile device), searching for the presence of lock devices is not carried out (step S139). On the other hand, when the first real-time identification information matches one of the unlocking information, the first identification information, and the second identification information of the manager electronic key (the manager mobile device), searching for the presence of a lock device is carried out (step S151). In step S153, it is determined whether a lock device is found. When the manager electronic key cannot create a connection with the lock device, the lock APP will not request input of a second real-time identification information (step S155: not requesting input of a second real-time identification information). On the other hand, when the manager electronic key is connected to the lock device, the lock APP requests input of a second real-time identification information (step S157: requesting input of a second real-time identification information). In step S159, it is determined whether the second real-time identification information is correct. When the second real-time identification information matches another of the remaining two of the unlocking information, the first identification information, and the second identification information of the manager electronic key (the manager mobile device), the manager electronic key sends an unlocking packet to the lock device (step S96). On the other hand, when the second real-time identification information matches none of the remaining two of the unlocking information, the first identification information, and the second identification information of the manager electronic key (the manager mobile device), the manager electronic key does not send an unlocking packet to the lock device (step S171).

Specifically, the first real-time identification information can correspond to one of the unlocking information, the first identification information, and the second identification information of the manager electronic key (the manager mobile device), and the second real-time identification information can correspond to another of the remaining two of the unlocking information, the first identification information, and the second identification information of the manager electronic key (the manager mobile device). Namely, the first and second real-time identification informations are different. For example, the first real-time identification information may be a fingerprint (corresponding to the unlocking information), and the second real-time identification information may be a password or facial data corresponding to the first or second real-time identification information.

In an example, the unlocking information of the manager electronic key is facial data, the first identification information is a password, and the second identification information is a fingerprint of the manager. When the double identification pattern operates, the lock APP requests input of facial data, a password, or a fingerprint. In a case that the inputted first real-time identification information is facial data, the lock APP compares the first real-time identification information with the unlocking information. In this state, the lock APP will request input of one of a password and a fingerprint as a second real-time identification information.

In another case that that the inputted first real-time identification information is a password, the lock APP will compare the first real-time identification information (in the form of a password) with the first identification information (in the form of a password). In this state, the lock APP will request input of one of facial data and a fingerprint as a second real-time identification information.

In a further case that that the inputted first real-time identification information is a fingerprint, the lock APP will compare the first real-time identification information with the second real-time identification information. In this state, the lock APP will request input of one of a password and facial data as a second real-time identification information.

When the unlocking packet is determined to be correct, the lock device is unlocked (step S113). On the other hand, when the unlocking packet is determined by the lock device as incorrect, the lock device is not unlocked (step S111). The processes for identifying the unlocking packet and execution of the unlocking command are the same as those of the quick pass pattern and the single identification pattern and, thus, will not be described to avoid redundancy.

It is worth noting that the unlocking command is not limited to control only one device. For example, the lock device may include a door lock and a door opener. Executing the unlocking command includes unlocking the door lock and actuating the door opener to move a door from a closed position to an open position. It can be appreciated that similar commands including control of a lock device having two or more units are still within the scope of the present invention.

Use of a user electronic key to carry out the unlocking procedure will be set forth hereinafter. When the user electronic key executes the lock APP, the lock APP is connected with the server to verify presence of valid authority of an unlocking digital key of the user electronic key (step S78: verifying presence of valid authority). In a case that there is no presence of valid authority of the unlocking digital key of the user electronic key, the unlocking digital key of the user electronic key without valid authority is deleted (step S80: deleting the unlocking digital key without valid authority). When the valid authority of the unlocking digital key is present, the unlocking digital key is kept.

Specifically, there are two cases of deleting the unlocking digital key originally owned by the user electronic key. In a first case, the manager uses the manager electronic key to select a corresponding user account name to check the unlocking digital key owned by the user (step S78). The manager can uses the interface of the lock APP to delete the unlocking digital key of the selected unlocking digital key of the selected user without valid authority (step S80). The manager electronic key sends the information of the deleted unlocking digital key to the server.

In a second case, an authorization period is set for the unlocking digital key granted to the user mobile device. When the authorization period expires, the lock APP, when executed, deletes the unlocking digital key whose authorization period expires (step S80).

Specifically, when the user electronic key executes the lock APP, the lock APP of the user electronic key is connected to the server to verify whether each unlocking digital key owned by the user electronic key is valid according to the record of the server. When at least one unlocking digital key owned by the user electronic key is invalid according to the record of the server (such as canceled from the record), the lock APP of the user electronic key deletes the at least one unlocking digital key from the user electronic key. Thus, the user cannot use the user electronic key to select the deleted unlocking digital key, such that the user electronic key cannot unlock or connect with the associated lock device whose unlocking authority is not granted to the user electronic key.

Furthermore, when the user electronic key executes the lock APP, the unlocking digital key for carrying out the unlocking procedure is permitted to be changed (step S82: whether to change the digital key). When another unlocking digital key is selected (step S86), the lock APP of the user electronic key will use the selected another unlocking digital key to carry out the subsequent unlocking procedure. On the other hand, when no other unlocking digital key is selected, the lock APP of the user electronic key will use the preset unlocking digital key to carry out the subsequent unlocking procedure (step S84).

When the quick pass pattern is selected for the management digital key selected by the user electronic key (step S88), operation of the lock APP will directly search whether any lock device is present in the communication range of the user electronic key (step S90: searching lock device). In step S92, it is determined whether a lock device is found. When the user electronic key is connected to a lock device, the user electronic key sends an unlocking packet (containing the unlocking digital key and an unlocking command) to the lock device (step S96). When no lock device is connected to the user electronic key, the lock APP does not send the unlocking packet (step S94). It is worth noting that the unlocking packet can be encrypted before sending, such that the information contained in the unlocking packet cannot be easily cracked even if the unlocking packet is intercepted during transmission.

In step S98, it is determined whether the unlocking packet is correct. When the unlocking packet is determined to be correct, the unlocking command is conducted (step S113). On the other hand, when the unlocking packet is determined to be incorrect, the unlocking command is not conducted (step S111). Specifically, after the user electronic key sends the unlocking packet to the lock device connected thereto, the lock device decrypts the unlocking packet to obtain the unlocking digital key and the unlocking command. Then, the hardware serial number contained the unlocking digital key is compared with the hardware serial number of the lock device itself. The unlocking command is conducted when they match, and the unlocking command is not conducted when they don't. On the other hand, the unlocking digital key and the unlocking command cannot be obtained when the lock device cannot decrypt the unlocking packet, such that the lock device cannot execute the unlocking command and, thus, remains in a forbidden state (such as locked). The identification of the unlocking packet and execution of the unlocking command are the same as those of the management electronic key, the detailed description thereof is not set forth to avoid redundancy.

In a case that the identification pattern preset by the user electronic key is the single identification pattern (step S115), the lock APP, when executed, requests input of a first real-time identification information (step S117 of inputting a first real-time identification information). In step S119, it is determined whether the first real-time identification information is correct by comparing it with the unlocking information, the first identification information, and the second identification information of the user electronic key (see step 119). When the first real-time identification information matches none of the unlocking information, the first identification information, and the second identification information of the user electronic key, searching for the presence of a lock device within the communication range is not carried out (step S131). On the other hand, when the first real-time identification information matches one of the unlocking information, the first identification information, and the second identification information of the user electronic key, searching for the presence of a lock device within the communication range is carried out (step S90). In step S92, it is determined whether a lock device is found. When the user electronic key is connected to a lock device, the user electronic key sends an unlocking packet (containing the unlocking digital key and an unlocking command) to the lock device (step S96). When no lock device is connected to the user electronic key, the lock APP does not send the unlocking packet (step S94).

Specifically, the first real-time identification information will be determined to be correct when the first real-time identification information matches one of the unlocking information, the first identification information, and the second identification information of the user electronic key (the user mobile device). For example, the unlocking information of the user electronic key is facial data of a person, the first identification is a password, and the second identification is a fingerprint of the user. When the single identification pattern operates, an interface of the lock APP requests input of facial data, a password, or a fingerprint (which can be chosen by the user). In a case that the user choses to input facial data as the first real-time identification information, the lock APP compares the first real-time identification information with the unlocking information. In another case that the user choses to input a password as the first real-time identification information, the lock APP compares the first real-time identification information with the first identification information. In a further case that the user choses to input a fingerprint as the first real-time identification information, the lock APP compares the first real-time identification information with the second identification information. Namely, the inputted the first real-time identification information only has to match one of the first identification information, the second identification information, and the locking information of the user electronic key.

When the unlocking packet is determined by the lock device as correct, the lock device is unlocked (step S113: executing the unlocking command). On the other hand, when the unlocking packet is determined by the lock device as incorrect, the lock device is not unlocked (step S111: not executing the unlocking command). The processes for identifying the unlocking packet and execution of the unlocking command are the same as those of the management electronic key and, thus, will not be described to avoid redundancy.

In a case that the selected management digital key is set to the double identification pattern, the lock device, when executed, requests input of a first real-time identification information (step S135). In step S137, it is determined whether the first real-time identification information is correct. When the first real-time identification information matches none of the unlocking information, the first identification information, and the second identification information of the user electronic key, searching for the presence of a lock device within the communication range of the user electronic key is not carried out (step S139). On the other hand, when the first real-time identification information matches one of the unlocking information, the first identification information, and the second identification information of the user electronic key, searching for the presence of a lock device within the communication range of the user electronic key is carried out (step S151), in step S153, it is determined whether a lock device is found. When the user electronic key cannot create a connection with the lock device, the lock APP will not request input of a second real-time identification information (step S155: not requesting input of a second real-time identification information). On the other hand, when the user electronic key is connected to the lock device, the lock APP requests input of a second real-time identification information (step S157: requesting input of a second real-time identification information). In step S159, it is determined whether the second real-time identification information is correct. When the second real-time identification information matches one of the remaining two of the unlocking information, the first identification information, and the second identification information of the user electronic key, the user electronic key sends an unlocking packet to the lock device (step S96). On the other hand, when the second real-time identification information matches none of the remaining two of the unlocking information, the first identification information, and the second identification information of the user electronic key, the user electronic key does not send an unlocking packet to the lock device (step S171).

Specifically, the first real-time identification information can correspond to one of the unlocking information, the first identification information, and the second identification information of the user electronic key, and the second real-time identification information corresponds to another of the unlocking information, the first identification information, and the second identification information of the user electronic key.

In an example, the unlocking information of the user electronic key is facial data, the first identification information is a password, and the second identification information is a fingerprint of the user. When the double identification pattern operates, the lock APP requests input of facial data, a password, or a fingerprint. In a case that the inputted first real-time identification information is facial data, the lock APP compares the first real-time identification information with the unlocking information. In this state, the lock APP swill request input of one of a password and a fingerprint as a second real-time identification information.

In another case that that the inputted first real-time identification information is a password, the lock APP will compare the first real-time identification information (in the form of a password) with the first identification information (in the form of a password). In this state, the lock APP will request input of one of facial data and a fingerprint as a second real-time identification information.

In a further case that that the inputted first real-time identification information is a fingerprint, the lock APP will compare the first real-time identification information with the second real-time identification information. In this state, the lock APP will request input of one of a password and facial data as a second real-time identification information. Namely, the inputted first real-time identification information can correspond to one of the unlocking information, the first identification information, and the second identification information of the user electronic key, and the inputted second real-time identification information corresponds to another of the unlocking information, the first identification information, and the second identification information of the user electronic key.

When the unlocking packet is determined to be correct, the lock device is unlocked (step S113). On the other hand, when the unlocking packet is determined by the lock device as incorrect, the lock device is not unlocked (step S111). The processes for identifying the unlocking packet and execution of the unlocking command are the same as those of the manager electronic key and, thus, will not be described to avoid redundancy.

Likewise, the unlocking command of the user electronic key is not limited to control only one device. For example, the lock device may include a door lock and a door opener. Executing the unlocking command includes unlocking the door lock and actuating the door opener to move a door from a closed position to an open position. It can be appreciated that similar commands including control of a lock device having two or more units are still within the scope of the present invention.

In methods of various embodiments according to the present invention, the user can register an account via the lock APP and then provide the registered account name to the holder of the manager electronic key. The holder of the manager electronic key can use at least one manager electronic key (owned by the manager and associated with the user account name) to remotely grant the unlocking authority to the user owning the account name. This provides excellent convenience (remote operation is permitted) and safety in operations of granting unlocking authority.

The authorization information ca be transmitted back to the server. The holder of the manager electronic key can remotely connect the manager electronic key with the server at any time to delete the unlocking authority of the unlocking digital key. When the user electronic key executing the lock APP and connected to the server verifies that there is no presence of valid authority of the unlocking digital key, the lock APP can automatically delete the unlocking digital key from the user electronic key. Thus, the user electronic key automatically loses the unlocking authority of the lock device associated with the unlocking digital key that has been deleted, providing excellent convenience and safety in operation of unlocking authority.

During account registration operation of the lock APP, the first and second identification informations are set by the user himself or herself and will not be sent to the manager electronic key during the operation of granting the unlocking authority. Only the account name is provided. Thus, the privacy of the user seeking unlocking authority is effectively protected.

When executing the unlocking procedure based on the single identification pattern, the manager or the user is permitted to input the first real-time identification information corresponding to the first or second identification information by himself or herself, which provides convenient unlocking while protecting the privacy.

While granting the unlocking authority, the identification pattern for the unlocking procedure can be selected from one of the quick pass pattern, the single identification pattern, and the double identification pattern. Thus, the holder of the manager electronic key can select a proper identification pattern based on the identify of the person seeking unlocking authority, the relationship between the person and the holder, the situation of granting unlocking authority, etc.

Regarding the quick pass pattern, automatic unlocking can be carried out after connection with a lock device with an unlocking authority while the lock APP is running. Namely, the quick pass pattern does not need to carry out the unlocking procedure that requires input of the first real-time identification information or input of the first and second real-time identification informations, providing use convenience.

Now that the basic teachings of the present invention have been explained, many extensions and variations will be obvious to one having ordinary skill in the art. For example, the methods according to the present invention are not limited to application to various locks. For example, the methods according to the present invention may be applied to electric doors or gates which can be opened only after verification of identity or authority or applied to devices which can be unlocked only after verification of identity or authority. These simple replacements and variations are all within the scope of the present invention.

Furthermore, the lock device may be a commercially available cathode lock that may be connected to external equipment with a wireless connection function. Such external equipment may wirelessly control unlocking of the cathode lock. For example, the external equipment is wirelessly connected to the manager electronic key and the user electronic key. A signal may be wirelessly sent by the external equipment to the cathode lock for unlocking purposes while the manager electronic key or the user electronic key passes verification. Similar approaches of using external hardware with a wireless connection function to control unlocking or similar operation of a commercially available device without wireless connection functions are also within the scope of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A method for operating a lock device comprising:

using a mobile device to register an account via a lock application (lock APP), wherein the account includes an account name and an account password which are set by a user using the mobile device;

creating a first identification information and a second identification information and storing the first and second identification information in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

determining whether to change an identification pattern of an unlocking procedure, when the identification pattern is not changed, a preset identification pattern is selected from a quick pass pattern, a single identification pattern, and a double identification pattern and is used for the unlocking procedure, wherein when the identification pattern of the unlocking procedure is changed, another of the quick pass pattern, the single identification pattern, and the double identification pattern is selected as the preset identification pattern, wherein when the preset identification pattern is the quick pass pattern, the lock APP is operated to search for presence of a lock device within a communication range of the management electronic key, wherein when the manager electronic key is connected to a lock device present in the communication range, the manager electronic key sends an unlocking packet containing the manager digital key and an unlocking command to the lock device, wherein when the manager electronic key is not connected to any lock device, the manager electronic key does not send the unlocking packet, wherein when the preset identification pattern is the single identification pattern, the lock APP is operated to request input of a first real-time identification information, wherein when the first real-time identification information matches none of the first and second identification information, searching for presence of a lock device within the communication range of the management digital key is not carried out, wherein when the first real-time identification information matches one of the first and second identification information, searching for the presence of a lock device within the communication range of the management electronic key is carried out, wherein when the manager electronic key is connected to a lock device present in the communication range, the manager electronic key sends an unlocking packet containing the manager digital key and an unlocking command to the lock device, wherein when the manager electronic key is not connected to any lock device, the manager electronic key does not send the unlocking packet, wherein when the preset identification pattern is the double identification pattern, the lock APP is operated to request input of a first real-time identification information, wherein when the first real-time identification information matches none of the first and second identification information, searching for the presence of a lock device within the communication range of the management digital key is not carried out, wherein when the first real-time identification information matches one of the first and second identification information, searching for the presence of a lock device within the communication range of the management digital key is carried out, wherein the manager electronic key requests input of a second real-time identification information when the manager electronic key is connected to the lock device, wherein when the second real-time identification information matches another of the first and second identification information, the manager electronic key sends an unlocking packet to the lock device connected to the manager electronic key, wherein when the second real-time identification information does not match another of the first and second identification information, the manager electronic key does not send the unlocking packet, wherein when the unlocking packet is determined by the lock device connected to the manager electronic key to be correct, the lock device connected to the manager electronic key is unlocked; and wherein when the unlocking packet is determined by the connected lock device to be incorrect, the lock device connected to the manager electronic key is not unlocked.

2. The method for operating the lock device as claimed in claim 1, wherein the lock APP obtains an unlocking information preset in the manager electronic key, wherein the lock APP requests input of a real-time unlocking information before execution of the change of the identification pattern of the unlocking procedure, wherein when the inputted real-time unlocking information matches the unlocking information preset in the manager electronic key, the change of the identification pattern of the unlocking procedure is carried out, and wherein when the inputted real-time unlocking information does not match the preset unlocking information of the manager electronic key, the change of the identification pattern of the unlocking procedure is not carried out.

3. The method for operating the lock device as claimed in claim 1, wherein determination of the unlocking packet by the lock device connected to the manager electronic key includes decrypting the unlocking packet to obtain the manager digital key and an unlocking command in the unlocking packet, wherein the lock device connected to the manager electronic key executes the unlocking command to unlock the lock device connected to the manager electronic key when the management digital key is determined to be correct, and wherein when the management digital key is determined to be incorrect, the lock device connected to the manager electronic key does not execute the unlocking command and remains locked.

4. The method for operating the lock device as claimed in claim 1, wherein the lock APP obtains an unlocking information preset in the manager electronic key, wherein with the identification pattern being the single identification pattern:

when the first real-time identification information matches one of the first identification information, the second identification information, and the unlocking information preset in the manager electronic key, searching for the presence of a lock device within the communication range of the management electronic key is carried out, and wherein when the first real-time identification information matches none of the first identification information, the second identification information, and the unlocking information preset in the manager electronic key, searching for the presence of a lock device within the communication range of the management electronic key is not carried out.

5. The method for operating the lock device as claimed in claim 1, wherein the lock APP obtains an unlocking information preset in the manager electronic key, wherein with the identification pattern being the double identification pattern:

when the first real-time identification information matches one of the first identification information, the second identification information, and the unlocking information preset in the manager electronic key, searching for the presence of a lock device within the communication range of the management digital key is carried out, wherein the lock APP requests input of a second real-time identification information when the manager electronic key is connected to a lock device present within the communication range of the management electronic key, wherein when the second real-time matches one of remaining two of the first identification information, the second identification information, and the unlocking information preset in the manager electronic key, the manager electronic key sends the unlocking packet to the lock device connected to the manager electronic key, wherein when the second real-time matches none of the remaining two of the first identification information, the second identification information, and the unlocking information preset in the manager electronic key, the manager electronic key does not send the unlocking packet to the lock device connected to the manager electronic key, when the first real-time identification information matches none of the first identification information, the second identification information, and the unlocking information preset in the manager electronic key, searching for the presence of a lock device within the communication range of the management digital key is not carried out.

6. The method for operating the lock device as claimed in claim 1, further comprising:

using the manager electronic key to connect with a plurality of another lock devices to thereby create a plurality of another management digital keys respectively associated with the plurality of another lock devices by respectively inputting a plurality of another hardware serial numbers respectively associated with the plurality of another lock devices, wherein the management digital key and the plurality of another management digital keys are stored in the manager electronic key;

using another mobile device to register another account via the lock APP, wherein the another account includes another account name and another account password which are set by another user using the another mobile device;

creating a third identification information and a fourth identification information and storing the third and fourth identification information in the another mobile device;

providing the registered another account of the another mobile device to the manager electronic key;

using the manager electronic key to select one of the management digital key and the plurality of another management digital keys according to the another account name of the registered another account, wherein the unlocking authority of the selected one of the management digital key and the plurality of another management digital keys is to be granted to the another mobile device and is used to create an unlocking digital key containing the hardware serial number of an associated lock device whose unlocking authority is to be granted;

sending an authorization packet containing the unlocking digital key to the another mobile device, wherein when decryption of the received authorization packet fails, the another mobile device is incapable of obtaining the unlocking digital key, wherein when decryption of the received authorization packet is successful, the another mobile device obtains the unlocking digital key and becomes a user electronic key;

wherein when the quick pass pattern is set as an identification pattern of an unlocking procedure of the unlocking digital key of the user electronic key, the lock APP is executed to search for the presence of a lock device within a communication range of the user electronic key, wherein when the user electronic key is connected to a lock device within the communication range of the user electronic key, the user electronic key sends another unlocking packet containing the unlocking digital key and an unlocking command to the lock device connected to the user electronic key, and wherein when the user electronic key is not connected to any lock device, the user electronic key does not send the another unlocking packet.

7. The method for operating the lock device as claimed in claim 6, wherein determination of the another unlocking packet by the lock device connected to the user electronic key includes decrypting, the another unlocking packet to obtain the unlocking digital key and the unlocking command in the another unlocking packet sent by the user electronic key, wherein the lock device connected to the user electronic key executes the unlocking command to unlock the lock device connected to the user electronic key when the unlocking digital key is determined to be correct, and wherein when the unlocking digital key is determined to be incorrect, the lock device connected to the user electronic key does not execute the unlocking command and remains locked.

8. The method for operating the lock device as claimed in claim 7, wherein with the single identification pattern set as the identification pattern of the unlocking procedure for the user electronic key:

the user electronic key executes the lock APP to request input of a third real-time identification information, wherein when the third real-time inputted into the user electronic key matches one of the third identification information, the fourth identification information, and an unlocking information of the user electronic key, searching for the presence of a lock device within the communication range of the user electronic key is carried out, wherein when the third real-time inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key, the user electronic key sends another unlocking packet to the lock device connected to the user electronic key, wherein when the user electronic key is not connected to any key, the user electronic lock device does not send the another unlocking packet.

9. The method for operating the lock device as claimed in claim 7, wherein with the double identification pattern set as the identification pattern of the unlocking procedure of the user electronic key:

wherein when a third real-time identification information inputted into the user electronic key matches one of the third identification information, the fourth identification information, and the unlocking information of the user electronic key, searching for the presence of a lock device within the communication range of the user electronic key is carried out, wherein when the third real-time identification information inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key the user electronic key requests input of a fourth real-time identification information, wherein when the user electronic key is not connected to any lock device, the user electronic key does not request input of the fourth real-time identification information, wherein when the inputted fourth real-time identification information matches one of remaining two of the third identification information, the fourth identification information, and the unlocking information of the user electronic key, the user electronic key sends another unlocking packet to the lock device connected to the user electronic key, wherein when the inputted second real-time identification information matches none of the remaining two of the third identification information, the fourth identification information, and the unlocking information of the user electronic key, the user electronic key does not send the another unlocking packet to the lock device connected to the user electronic key.

10. The method for operating the lock device as claimed in claim 6, further comprising:

binding the account name, the account password, and the management digital key together as a first packet and sending the first packet to a server;

binding the another account name, the another account password, and the unlocking digital key together as a second packet and sending the second packet to the server;

wherein when the manager digital key and the user electronic key execute the lock APP, the lock APP is connected to the server to verify presence of valid authority of the management digital key of the manager electronic key and presence of valid authority of the unlocking digital key of the user electronic key, wherein when the valid authority of the management digital key of the manager electronic key is not present, the management digital key of the manager electronic key without valid authority is deleted, wherein when the valid authority of the management digital key of the manager electronic key is present, the management digital key of the manager electronic key is kept, wherein when the valid authority of the unlocking digital key of the user electronic key is not present, the unlocking digital key of the user electronic key without valid authority is deleted, wherein when the valid authority of the unlocking digital key of the user electronic key is present, the user digital key of the user electronic key is kept.

11. The method for operating the lock device as claimed in claim 6, wherein an authorization period is simultaneously set while creating the unlocking digital key, and wherein the unlocking digital key with an expired authorization period is deleted while executing the lock APP.

12. A method for operating a lock device, comprising using a mobile device to register an account via a lock application (lock APP), wherein the account includes an account name and an account password which are set by a user using the mobile device;

creating a first identification information and a second identification information and storing the first and second identification information in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

operating the lock APP to selectively execute a single identification pattern, requesting input of a first real-time identification information, wherein when the first real-time identification information matches none of the first and second identification information, searching for the presence of a lock within a communication range of the manager electronic key is not carried out, wherein when the first real-time identification information matches one of the first and second identification information, searching for the presence of a lock within the communication range of the manager electronic key is carried out, wherein when the manager electronic key is connected to a lock device within communication range of the manager electronic key, the manager electronic key sends an unlocking packet to the lock device connected to the manager electronic key, wherein when the manager electronic key is not connected to any lock device, the manager electronic key does not send the unlocking packet, wherein when the unlocking packet is determined to be correct, the lock device connected to the manager electronic key is unlocked, wherein when the unlocking packet is determined to be incorrect, the lock device connected to the manager electronic key is not unlocked.

13. The method for operating the lock device as claimed in claim 12, wherein determination of the unlocking packet by the lock device connected to the manager electronic key includes decrypting the unlocking packet to obtain the manager digital key and an unlocking command in the unlocking packet, wherein the lock device connected to the manager electronic key executes the unlocking command to unlock the lock device connected to the manager electronic key when the management digital key is determined to be correct, and wherein when the management digital key is determined to be incorrect, the lock device connected to the manager electronic key does not execute the unlocking command and remains locked.

14. The method for operating the lock device as claimed in claim 12, wherein the method further includes a double identification pattern, wherein one of the single identification pattern and the double identification pattern is selected as a preset identification pattern of an unlocking procedure, wherein the lock APP obtains an unlocking information preset in the manager electronic key, wherein with the double identification pattern set as the preset identification pattern:

the manager electronic key executes the lock APP to request input of a first real-time identification information, wherein when the first real-time identification information matches one of the first identification information, the second identification information, and the unlocking information preset in the manager electronic key, searching for the presence of a lock device within the communication range of the management digital key is carried out, when the first real-time identification information matches none of the first identification information, the second identification information, and the unlocking information preset in the manager electronic key, searching for the presence of a lock device within the communication range of the management digital key is not carried out, wherein the lock APP requests input of a second real-time identification information when the manager electronic key is connected to a lock device present within the communication range of the management electronic key, wherein when the second real-time matches one of remaining two of the first identification information, the second identification information, and the unlocking information preset in the manager electronic key, the manager electronic key sends the unlocking packet to the lock device connected to the manager electronic key, wherein when the second real-time matches none of the remaining two of the first identification information, the second identification information, and the unlocking information preset in the manager electronic key, the manager electronic key does not send the unlocking packet to the lock device connected to the manager electronic key.

15. The method for operating the lock device as claimed in claim 12, further comprising:

using the manager electronic key to connect with a plurality of another lock devices to thereby create a plurality of another management digital keys respectively associated with the plurality of another lock devices by respectively inputting a plurality of another hardware serial numbers respectively associated with the plurality of another lock devices, wherein the management digital key and the plurality of another management digital keys are stored in the manager electronic key;

using another mobile device to register another account via the lock APP, wherein the another account includes another account name and another account password which are set by another user using the another mobile device;

creating a third identification information and a fourth identification information and storing the third and fourth identification information in the another mobile device;

providing the registered another account of the another mobile device to the manager electronic key;

using the manager electronic key to select one of the management digital key and the plurality of another management digital keys according to the another account name of the registered another account, wherein the unlocking authority of the selected one of the management digital key and the plurality of another management digital keys is to be granted to the another mobile device and is used to create an unlocking digital key containing the hardware serial number of an associated lock device whose unlocking authority is to be granted;

sending an authorization packet containing the unlocking digital key to the another mobile device, wherein when decryption of the received authorization packet fails, the another mobile device is incapable of obtaining the unlocking digital key, wherein when decryption of the received authorization packet is successful, the another mobile device obtains the unlocking digital key and becomes a user electronic key;

wherein the user electronic key executes the lock APP to request input of a third real-time identification information, when a third real-time inputted into the user electronic key matches one of the third identification information, the fourth identification information, and an unlocking information of the user electronic key, searching for the presence of a lock device within the communication range of the user electronic key is carried out, wherein when the third real-time inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key, the user electronic key sends another unlocking packet to the lock device connected to the user electronic key, and wherein when the user electronic key is not connected to any key, the user electronic lock device does not send the another unlocking packet.

16. The method for operating the lock device as claimed in claim 15, wherein determination of the another unlocking packet by the lock device connected to the user electronic key includes decrypting the another unlocking packet to obtain the unlocking digital key and the unlocking command in the another unlocking packet sent by the user electronic key, wherein the lock device connected to the user electronic key executes the unlocking command to unlock the lock device connected to the user electronic key when the unlocking digital key is determined to be correct, and wherein when the unlocking digital key is determined to be incorrect, the lock device connected to the user electronic key does not execute the unlocking command and remains locked.

17. The method for operating the lock device as claimed in claim 16, wherein the method further includes a double identification pattern, wherein one of the single identification pattern and the double identification pattern is selected as a preset identification pattern of an unlocking procedure, wherein with the double identification pattern set as the preset identification pattern, the user electronic key executes the lock APP to request input of a third real-time identification information, wherein when a third real-time identification information inputted into the user electronic key matches one of the third identification information, the fourth identification information, and the unlocking information of the user electronic key, searching for the presence of a lock device within the communication range of the user electronic key is carried out, wherein when the third real-time identification information inputted into the user electronic key matches none of the third identification information, the fourth identification information, and the unlocking information of the user electronic key, searching for the presence of a lock device within the communication range of the user electronic key is not carried out, wherein when the user electronic key is connected to a lock device within the communication range of the user electronic key, the user electronic key requests input of a fourth real-time identification information, wherein when the user electronic key is not connected to any lock device, the user electronic key does not request input of the fourth real-time identification information, wherein when the inputted fourth real-time identification information matches one of remaining two of the third identification information, the fourth identification information, and the unlocking information of the user electronic key the user electronic key sends another unlocking packet to the lock device connected to the user electronic key, wherein when the inputted fourth real-time identification information matches none of the remaining two of the third identification information, the fourth identification information, and the unlocking information of the user electronic key, the user electronic key does not send the another unlocking packet to the lock device connected to the user electronic key.

18. The method for operating the lock device as claimed in claim 15, wherein the method further includes a quick pass pattern, wherein one of the single identification pattern and the quick pass pattern is selected as a preset identification pattern of an unlocking procedure, wherein with the quick pass pattern set as the preset identification pattern:

the lock APP is executed to search for the presence of a lock device within a communication range of the user electronic key wherein the user electronic key sends an unlocking packet containing the unlocking digital key and an unlocking command to the lock device connected to the user electronic key, and wherein when the user electronic key is not connected to any lock device, the user electronic key does not send the unlocking packet.

19. The method for operating the lock device as claimed in claim 15, further comprising:

binding the account name, the account password, and the management digital key together as a first packet and sending the first packet to a server;

wherein when the manager digital key executes the lock APP, the lock APP is connected to the server to verify presence of valid authority of the management digital key of the manager electronic key, wherein when the valid authority of the management digital key of the manager electronic key is not present, the management digital key of the manager electronic key without valid authority is deleted, wherein when the valid authority of the management digital key of the manager electronic key is present, the management digital key of the manager electronic key is kept.

20. The method for operating the lock device as claimed in claim 19, further comprising binding the another account name, the another account password, and the unlocking digital key together as a second packet and sending the second packet to the server, wherein when the user electronic key executes the lock APP, the lock APP is connected to the server to verify presence of valid authority of the unlocking digital key of the user electronic key, wherein when the valid authority of the unlocking digital key of the user electronic key is not present, the unlocking digital key of the user electronic key without valid authority is deleted, wherein when the valid authority of the unlocking digital key of the user electronic key is present, the user digital key of the user electronic key is kept.

21. The method for operating the lock device as claimed in claim 15, wherein an authorization period is simultaneously set while creating the unlocking digital key, and wherein the unlocking digital key with an expired authorization period is deleted while executing the lock APP.

22. A method for operating a lock device, comprising:

using a mobile device to register an account via a lock application (lock APP), wherein the account includes an account name and an account password which are set by a user using the mobile device:

creating a first identification information and a second identification information and storing the first and second identification information in the mobile device;

requesting input of a hardware serial number when the mobile device is connected to a lock device whose management authority has not been granted to the mobile device, wherein when the inputted hardware serial number is determined to be correct, a management digital key containing the hardware serial number of the lock device connected to the mobile device is created in the mobile device, and the mobile device becomes a manager electronic key including the management digital key, wherein when the mobile device is not connected to any lock device or the inputted hardware serial number determined to be incorrect, the management digital key cannot be created;

operating the lock APP to selectively execute a double identification pattern, thereby requesting input of a first real-time identification information, wherein when the first real-time identification information matches none of the first and second identification information, searching for the presence of a lock device within the communication range of the management digital key is not carried out, wherein when the first real-time identification information matches one of the first and second identification information, searching for the presence of a lock device within the communication range of the management digital key is carried out, wherein the manager electronic key requests input of a second real-time identification information when the manager electronic key is connected to the lock device, wherein the manager electronic key does not request input of the second real-time identification information when the manager electronic key is incapable of connecting with the lock device, wherein when the second real-time identification information matches another of the first and second identification information, the manager electronic key sends an unlocking packet to the lock device connected to the manager electronic key, wherein when the second real-time identification information does not match another of the first and second identification information, the manager electronic key does not send the unlocking packet;

wherein when the unlocking packet is determined to be correct, the lock device connected to the manager electronic key is unlocked, wherein when the unlocking packet is determined to be incorrect, the lock device connected to the manager electronic key is not unlocked.

23. The method for operating the lock device as claimed in claim 22, wherein determination of the unlocking packet by the lock device connected to the manager electronic key includes decrypting the unlocking packet to obtain the manager digital key and an unlocking command in the unlocking packet, wherein the lock device connected to the manager electronic key executes the unlocking command to unlock the lock device connected to the manager electronic key when the management digital key is determined to be correct, and wherein when the management digital key is determined to be incorrect, the lock device connected to the manager electronic key does not execute the unlocking command and remains locked.

24. The method for operating the lock device as claimed in claim 22, further comprising:

using the manager electronic key to connect with a plurality of another lock devices to thereby create a plurality of another management digital keys respectively associated with the plurality of another lock devices by respectively inputting a plurality of another hardware serial numbers respectively associated with the plurality of another lock devices, wherein the management digital key and the plurality of another management digital keys are stored in the manager electronic key;

using another mobile device to register another account via the lock APP, wherein the another account includes another account name and another account password which are set by another user using the another mobile device;

creating a third identification information and a fourth identification information and storing the third and fourth identification information in the another mobile device;

providing the registered another account of the another mobile device to the manager electronic key;

using the manager electronic key to select one of the management digital key and the plurality of another management digital keys according to the another account name of the registered another account, wherein the unlocking authority of the selected one of the management digital key and the plurality of another management digital keys is to be granted to the another mobile device and is used to create an unlocking digital key containing the hardware serial number of an associated lock device whose unlocking authority is to be granted;

sending an authorization packet containing the unlocking digital key to the another mobile device, wherein when decryption of the received authorization packet fails, the another mobile device is incapable of obtaining the unlocking digital key, wherein when decryption of the received authorization packet is successful, the another mobile device obtains the unlocking digital key and becomes a user electronic key;

wherein when the double identification pattern is set as an identification pattern of an unlocking procedure of the unlocking digital key of the user electronic key, the lock APP is executed to search for the presence of a lock device within a communication range of the user electronic key, wherein the user electronic key executes the lock APP to request input of a third real-time identification information, wherein when the third real-time identification information matches one of the third identification information, the fourth identification information, and an unlocking information preset in the user electronic key, searching for the presence of a lock device within the communication range of the user digital key is carried out, wherein the lock APP requests input of a fourth real-time identification information when the user electronic key is connected to a lock device present within the communication range of the user electronic key, wherein when the fourth real-time matches one of remaining two of the third identification information, the fourth identification information, and the unlocking information preset in the user electronic key, the user electronic key sends the unlocking packet to the lock device connected to the user electronic key, wherein when the fourth real-time matches none of the remaining two of the third identification information, the fourth identification information, and the unlocking information preset in the user electronic key, the user electronic key does not send the unlocking packet to the lock device connected to the user electronic key, when the first real-time identification information matches none of the first identification information, the second identification information, and the unlocking information preset in the manager electronic key, searching for the presence of a lock device within the communication range of the management digital key is not carried out.

25. The method for operating the lock device as claimed in claim 24, wherein determination of the another unlocking packet by the lock device connected to the user electronic key includes decrypting the another unlocking packet to obtain the unlocking digital key and the unlocking command in the another unlocking packet sent by the user electronic key, wherein the lock device connected to the user electronic key executes the unlocking command to unlock the lock device connected to the user electronic key when the unlocking digital key is determined to be correct, and wherein when the unlocking digital key is determined to be incorrect, the lock device connected to the user electronic key does not execute the unlocking command and remains locked.

26. The method for operating the lock device as claimed in claim 24, wherein the method further includes a single identification pattern, wherein one of the double identification pattern and the single identification pattern is selected as a preset identification pattern of the unlocking procedure, wherein with the single identification pattern set as the preset identification pattern of the user electronic key, the lock APP requests input of a third real-time identification information, wherein when the third real-time identification information matches none of the third and fourth identification information, searching for the presence of a lock within the communication range of the user electronic key is not carried out, wherein when the third real-time identification information matches one of the third and fourth identification information, searching for the presence of a lock within the communication range of the user electronic key is carried out, wherein when the user electronic key is connected to a lock device within communication range of the user electronic key, the user electronic key sends an unlocking packet to the lock device connected to the user electronic key, wherein when the user electronic key is not connected to any lock device, the user electronic key does not send the unlocking packet.

27. The method for operating the lock device as claimed in claim 24, wherein the method further includes a quick pass pattern, wherein one of the double identification pattern and the quick pass pattern is selected as a preset identification pattern of the unlocking procedure, wherein with the quick pass pattern set as the preset identification pattern of the user electronic key, the lock APP is executed to search for the presence of a lock device within the communication range of the user electronic key, wherein the user electronic key sends an unlocking packet containing the unlocking digital key and an unlocking command to the lock device connected to the user electronic key, and wherein when the user electronic key is not connected to any lock device, the user electronic key does not send the unlocking packet.

28. The method for operating the lock device as claimed in claim 24, further comprising:

binding the account name, the account password, and the management digital key together as a first packet and sending the first packet to a server;

wherein when the manager digital key executes the lock APP, the lock APP is connected to the server to verify presence of valid authority of the management digital key of the manager electronic key, wherein when the valid authority of the management digital key of the manager electronic key is not present, the management digital key of the manager electronic key without valid authority is deleted, wherein when the valid authority of the management digital key of the manager electronic key is present, the management digital key of the manager electronic key is kept.

29. The method for operating the lock device as claimed in claim 28, further comprising binding the another account name, the another account password, and the unlocking digital key together as a second packet and sending the second packet to the server, wherein the user electronic key executes the lock APP, the lock APP is connected to the server to verify presence of valid authority of the unlocking digital key of the user electronic key, wherein when the valid authority of the unlocking digital key of the user electronic key is not present, the unlocking digital key of the user electronic key without valid authority is deleted, wherein when the valid authority of the unlocking digital key of the user electronic key is present, the user digital key of the user electronic key is kept.

30. The method for operating the lock device as claimed in claim 24, wherein an authorization period is simultaneously set while creating the unlocking digital key, and wherein the unlocking digital key with an expired authorization period is deleted while executing the lock APP.

* * * * *